US011198031B2

(12) United States Patent
Chen

(10) Patent No.: US 11,198,031 B2
(45) Date of Patent: Dec. 14, 2021

(54) ADJUSTABLE EXERCISE DEVICE

(71) Applicant: FLORIEY INDUSTRIES INTERNATIONAL CO., Taichung (TW)

(72) Inventor: Paul Chen, Taichung (TW)

( * ) Notice: Subject to any disclaimer, the term of this patent is extended or adjusted under 35 U.S.C. 154(b) by 52 days.

(21) Appl. No.: 16/853,844

(22) Filed: Apr. 21, 2020

(65) Prior Publication Data

US 2021/0322817 A1 Oct. 21, 2021

(51) Int. Cl.
*A63B 21/072* (2006.01)
*A63B 21/075* (2006.01)

(52) U.S. Cl.
CPC ..... *A63B 21/0728* (2013.01); *A63B 21/072* (2013.01); *A63B 21/075* (2013.01); *A63B 21/0724* (2013.01); *A63B 21/0726* (2013.01)

(58) Field of Classification Search
None
See application file for complete search history.

(56) References Cited

U.S. PATENT DOCUMENTS 5,407,413 A 4/1995 Kupferman
5,839,997 A 11/1998 Roth et al.
6,656,093 B2 12/2003 Chen
7,223,214 B2 5/2007 Chen
7,731,641 B1 6/2010 Chen
7,811,213 B2 10/2010 Chen
9,616,273 B2 4/2017 Chen
9,956,451 B1 * 5/2018 Wang ..... A63B 21/0728
10,343,010 B2 7/2019 Chen
10,843,027 B2 * 11/2020 Wang ..... A63B 21/0728
2010/0304939 A1 * 12/2010 Svenberg ..... A63B 21/072 482/108
2013/0324375 A1 * 12/2013 Svenberg ..... A63B 21/0728 482/108
2014/0349820 A1 * 11/2014 Wang ..... A63B 21/0726 482/108
2015/0360073 A1 * 12/2015 Moran ..... A63B 21/0726 482/107
2017/0239510 A1 * 8/2017 Wang ..... A63B 21/0726
2017/0252599 A1 * 9/2017 Wang ..... A63B 21/075
2018/0078810 A1 * 3/2018 Chen ..... A63B 21/075
2018/0078811 A1 * 3/2018 Chen ..... A63B 21/0726
2018/0169459 A1 * 6/2018 Wang ..... A63B 71/0619
2018/0353794 A1 * 12/2018 Wang ..... A63B 21/075

* cited by examiner

*Primary Examiner* — Joshua Lee
(74) *Attorney, Agent, or Firm* — Charles Baxley

(57) ABSTRACT

An adjustable exercise device includes two weight members engageable to a receptacle, two pairs of weight elements engaged on the receptacle and engaged between the weight members, and a handle mechanism includes two housings disposed on the end portions of a handle bar, two actuators pivotally attached to the handle bar for engaging with the weight elements, the actuators each include one segment for engaging with one of the weight elements, and another segment for engaging with the other weight element and for detachably anchoring the weight elements to the housings and the handle bar and for micro-adjusting the weight of the adjustable exercise device.

9 Claims, 7 Drawing Sheets

ADJUSTABLE EXERCISE DEVICE

BACKGROUND OF THE INVENTION

1. Field of the Invention

The present invention relates to an adjustable exercise device, and more particularly to an adjustable barbell, kettle bell, or dumbbell having an adjustable structure or configuration for micro adjusting the weight of the adjustable exercise device, and arranged for allowing the weight or the size or the standard of the weight members or of the adjustable exercise device or the adjustable dumbbell to be suitably micro-adjusted.

2. Description of the Prior Art

Various kinds of typical adjustable barbells, kettle bells, or dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, U.S. Pat. No. 9,616,273 to Chen, and U.S. Pat. No. 10,343,010 to Chen disclose several of the typical adjustable dumbbells each including a number of weight rings or weight members that may be selectively or adjustably secured together for adjusting the weight of the dumbbells.

Normally, in the typical adjustable dumbbells, two or more pairs of weight members are provided for attaching to the end portions of the central handle bar, and for balancing purposes, the weight rings or weight members are attached to the end portions of the central handle bar in pair, and may not be selectively or adjustably secured to the central handle bar with a weight ring or weight member having a decreased weight.

However, the weight members are required to be attached to the end portions of the central handle bar in pair, and the total weight of the weight members attached to the central handle bar may not be micro-adjusted.

The present invention has arisen to mitigate and/or obviate the afore-described disadvantages of the conventional adjustable barbells, kettle bells, or dumbbells.

SUMMARY OF THE INVENTION

The primary objective of the present invention is to provide an adjustable barbell, kettle bell, or dumbbell including an adjustable structure or configuration for micro adjusting the weight of the adjustable exercise device, and arranged for allowing the weight or the size or the standard of the weight members or of the adjustable exercise device or the adjustable dumbbell to be suitably micro-adjusted.

In accordance with one aspect of the invention, there is provided an adjustable exercise device comprising a receptacle, a first weight member and a second weight member engageable to the receptacle, two first weight elements engaged on the receptacle and engaged between the first and the second weight members, two second weight elements engaged on the receptacle and engaged between the first and the second weight members, the first weight elements being located closer to the first and the second weight members than the second weight elements, and a handle mechanism engaged between the first and the second weight members for anchoring the first and the second weight members to the handle mechanism, the handle mechanism including a handle bar having two end portions, a first and a second housings disposed on the end portions of the handle bar respectively, two actuators pivotally attached to the end portions of the handle bar for engaging with the first and the second weight elements respectively, and the actuators each including a first segment for engaging with the first weight element, and a second segment for engaging with the second weight element respectively and for detachably anchoring the first and the second weight elements to the housings and the handle bar.

The actuators each include a first tongue formed on the first segment for engaging with the first weight element when the actuators are rotated relative to the first and the second housings in one direction, a second tongue formed on the first segment for engaging with the first weight element when the actuators are rotated relative to the first and the second housings in an opposite direction, and a projection formed on the second segment for engaging with the second weight element when the actuators are rotated relative to the first and the second housings in the opposite direction.

The first and the second weight elements each include at least one depression for engaging with the first and the second tongues and the projection. The first and the second weight elements each include an opening for receiving and engaging with the actuators respectively, and the depression of the first and the second weight elements is communicating with the opening of the first and the second weight elements.

The actuators each include a knob for rotating the actuators relative to the first and the second housings and the handle bar respectively. The first and the second housings each include a groove formed in the first and the second housings respectively, and the actuators each include a pin extended from the knob and slidably received and engaged in the groove of the first and the second housings for guiding and limiting the actuators to or rotate relative to the first and the second housings. The first and the second housings each include a frame, and the groove is formed in the frame.

The handle mechanism includes a first and a second tubular members engaged between the first and the second housings and separated from each other, a bore is formed in each of the first and the second tubular members respectively, the first weight member includes an orifice formed in the first weight member, and the second weight member includes an aperture formed in the second weight member, a first latch is slidably received and engaged in the bore of the first tubular member for engaging with the orifice of the first weight member and for retaining the first weight member to the first housing, and a second latch is slidably received and engaged in the bore of the second tubular member and extendible out of the aperture of the second housing for engaging with the aperture of the second weight member and for retaining the second weight member to the second housing. The first housing includes an opening formed in the first housing and aligned with the bore of the first tubular member, and the second housing includes a hole formed in the second housing and aligned with the bore of the second tubular member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 5:
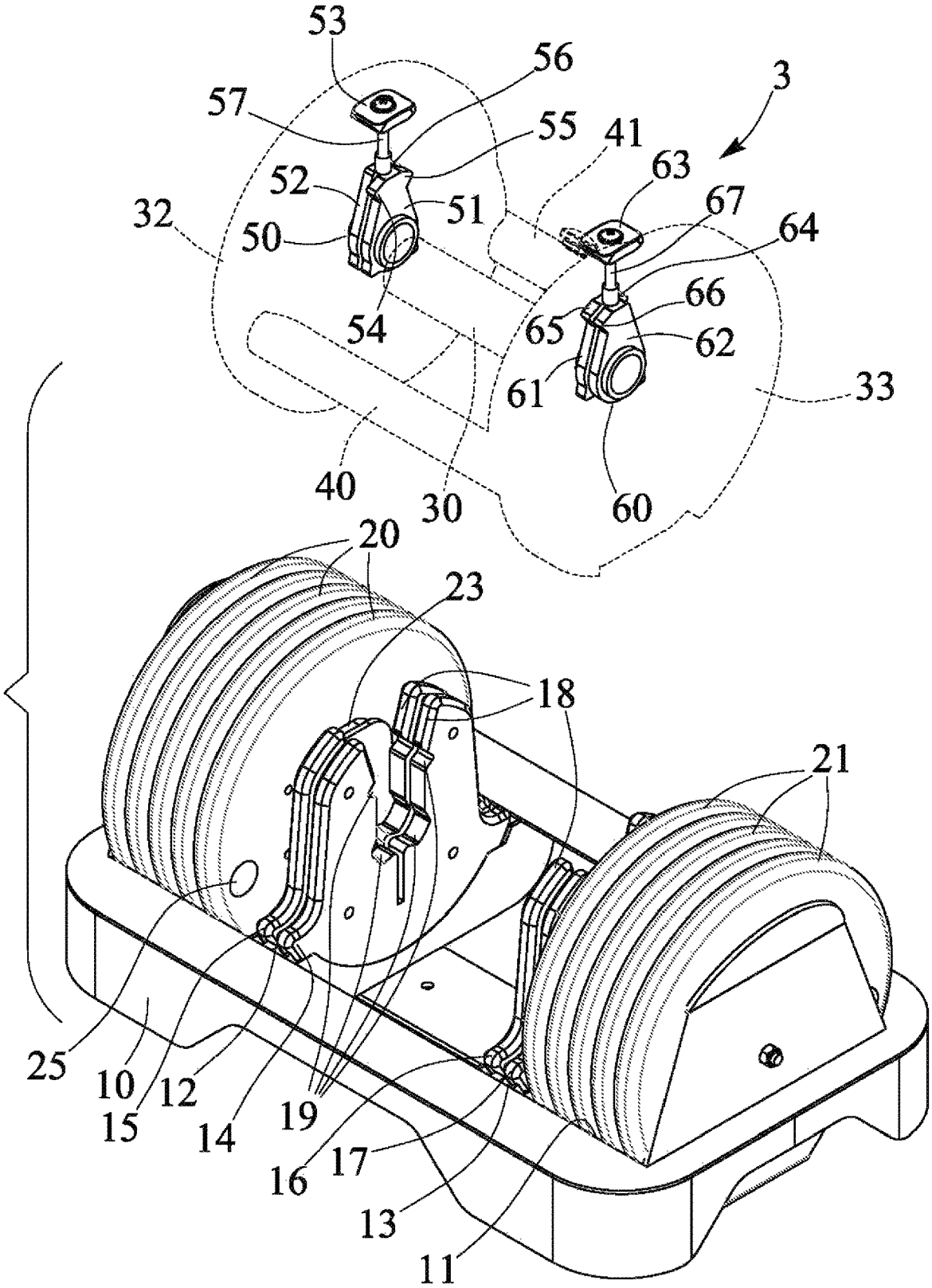
FIG. 5 is a further partial exploded view of the adjustable exercise device.
Figure 6:
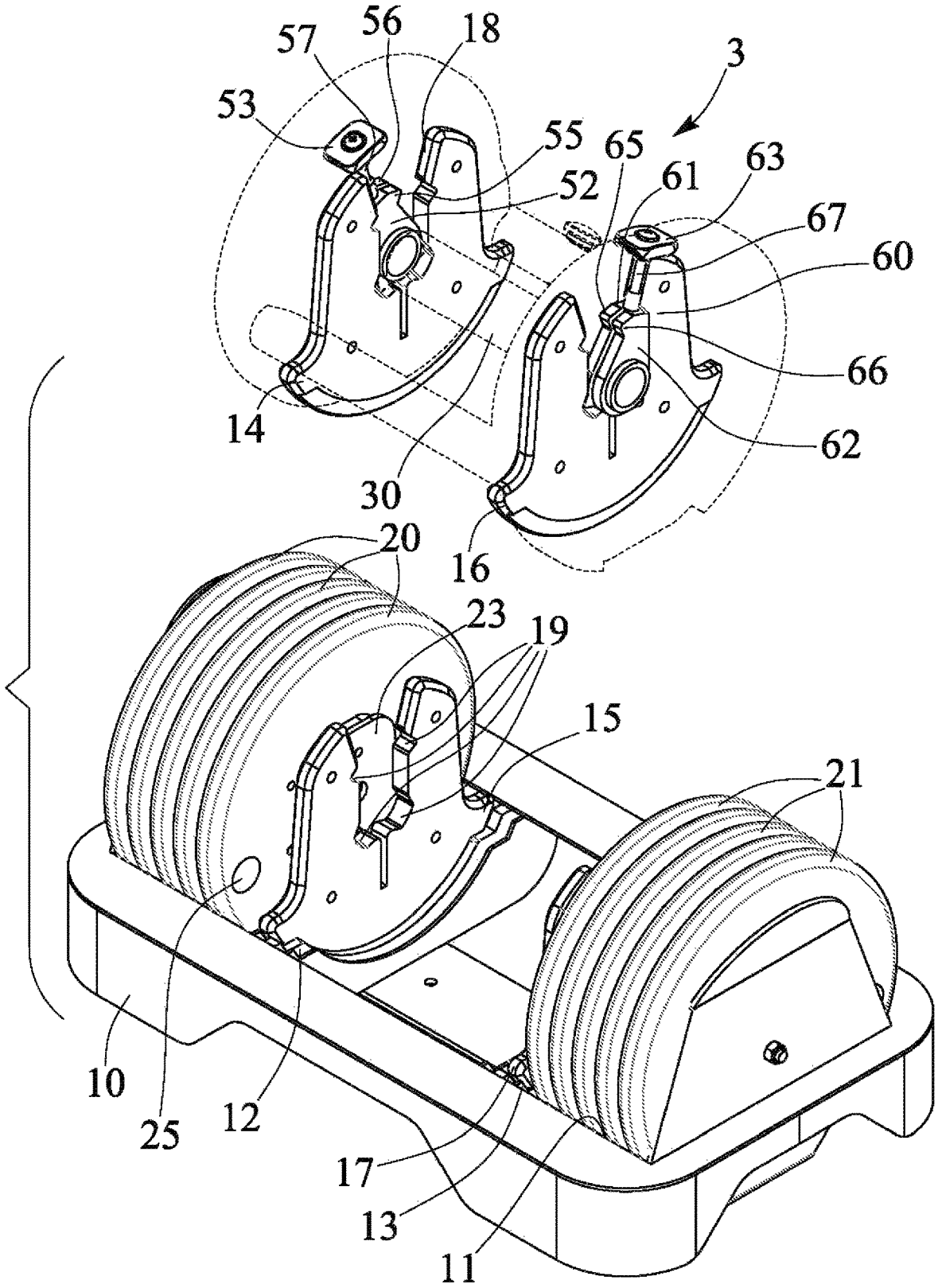
FIGS. 6, 7 are further partial exploded views similar to FIG. 5, illustrating the operation of the adjustable dumbbell assembly.
Figure 7:
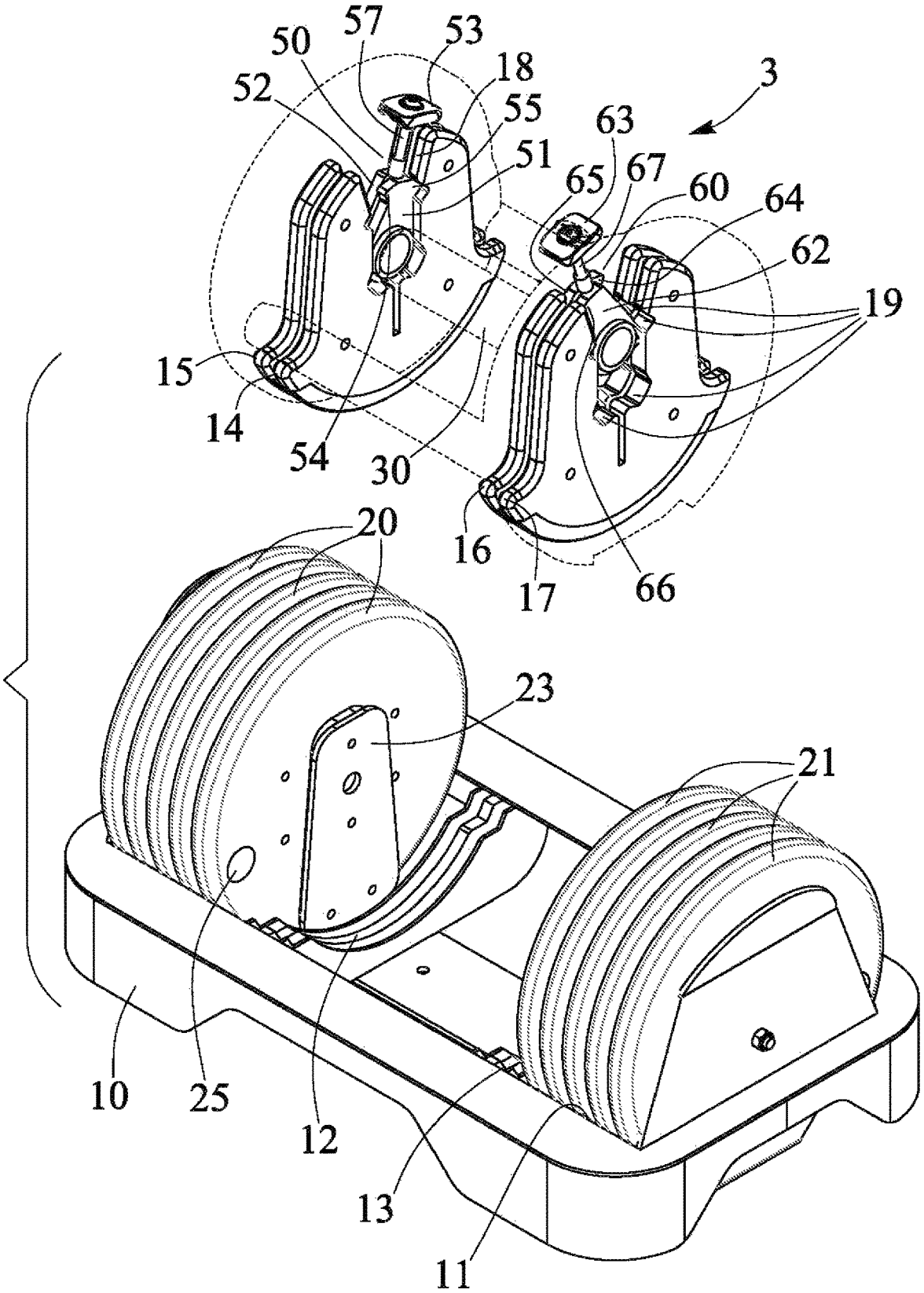

Referring to the drawings, and initially to FIGS. 1-5, an adjustable exercise device, such as an adjustable barbell, kettle bell, or dumbbell in accordance with the present invention comprises a supporting base or receptacle 10 including one or more (such as two) depressions or recesses or compartments 11 formed therein for selectively receiving or engaging with two groups of weights 20, 21, such as weight rings or plates or members or elements, and including one or more (such as two) spacer plates or partitions or seats 12, 13 extended in the receptacle 10 and disposed and arranged or located between the two compartments 11 of the receptacle 10, and/or disposed and arranged or located between the two groups of the weight members 20, 21, and the seats 12, 13 are disengaged or separated from each other, best shown in FIGS. 6 and 7. The seats 12, 13 are provided for receiving or engaging with or supporting weight elements 14, 15, 16, 17 therein, and the weight elements 14-17 each include a cavity or notch or opening 18 formed therein, such as formed in the middle or intermediate portion thereof, and each include one or more (such as four or two pairs of) cavities or recesses or depressions 19 formed therein and communicating with the opening 18 of the weight elements 14-17 respectively.

Figure 1:
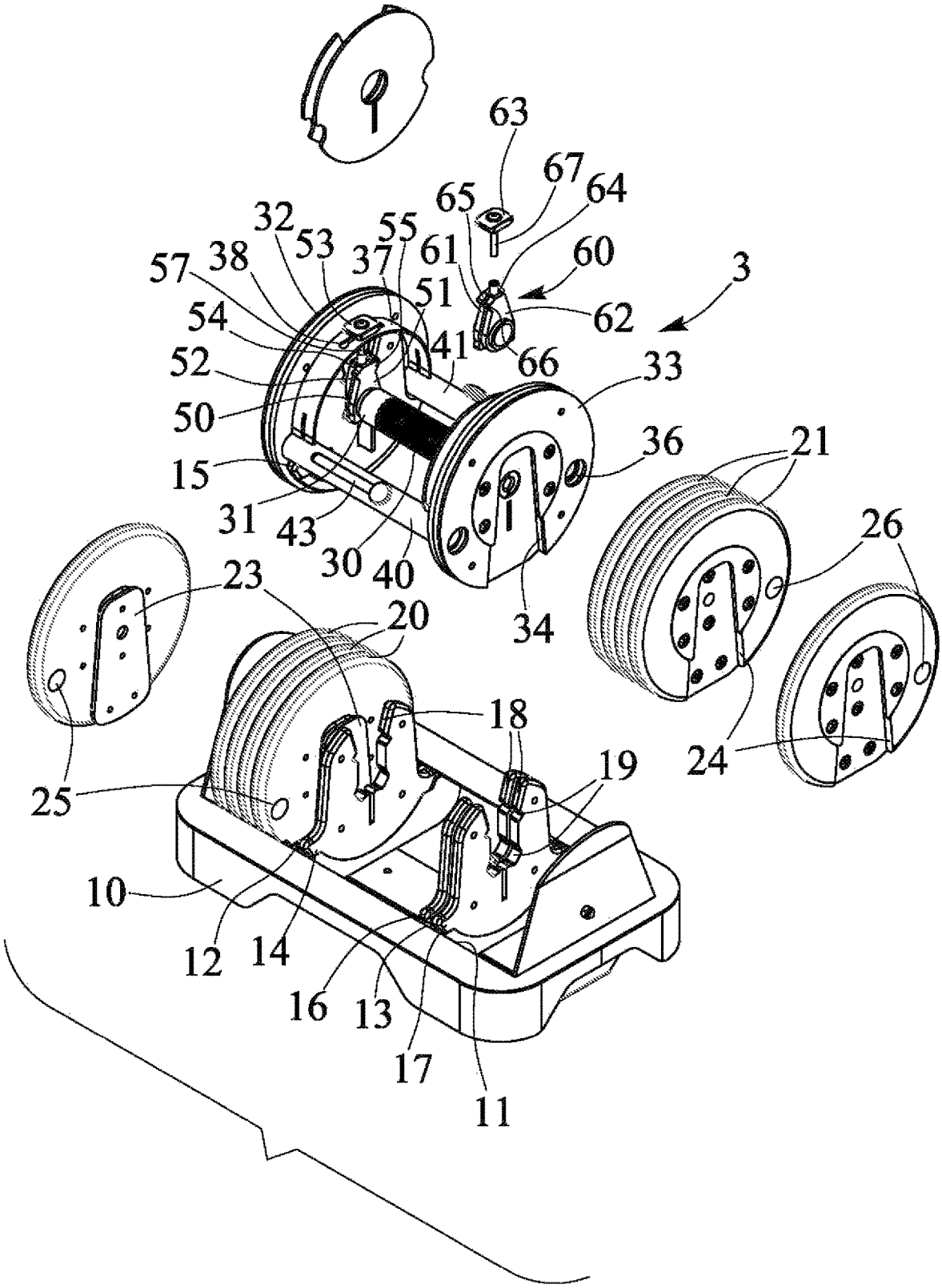
FIG. 1 is a partial exploded view of an adjustable exercise device in accordance with the present invention.
Figure 2:
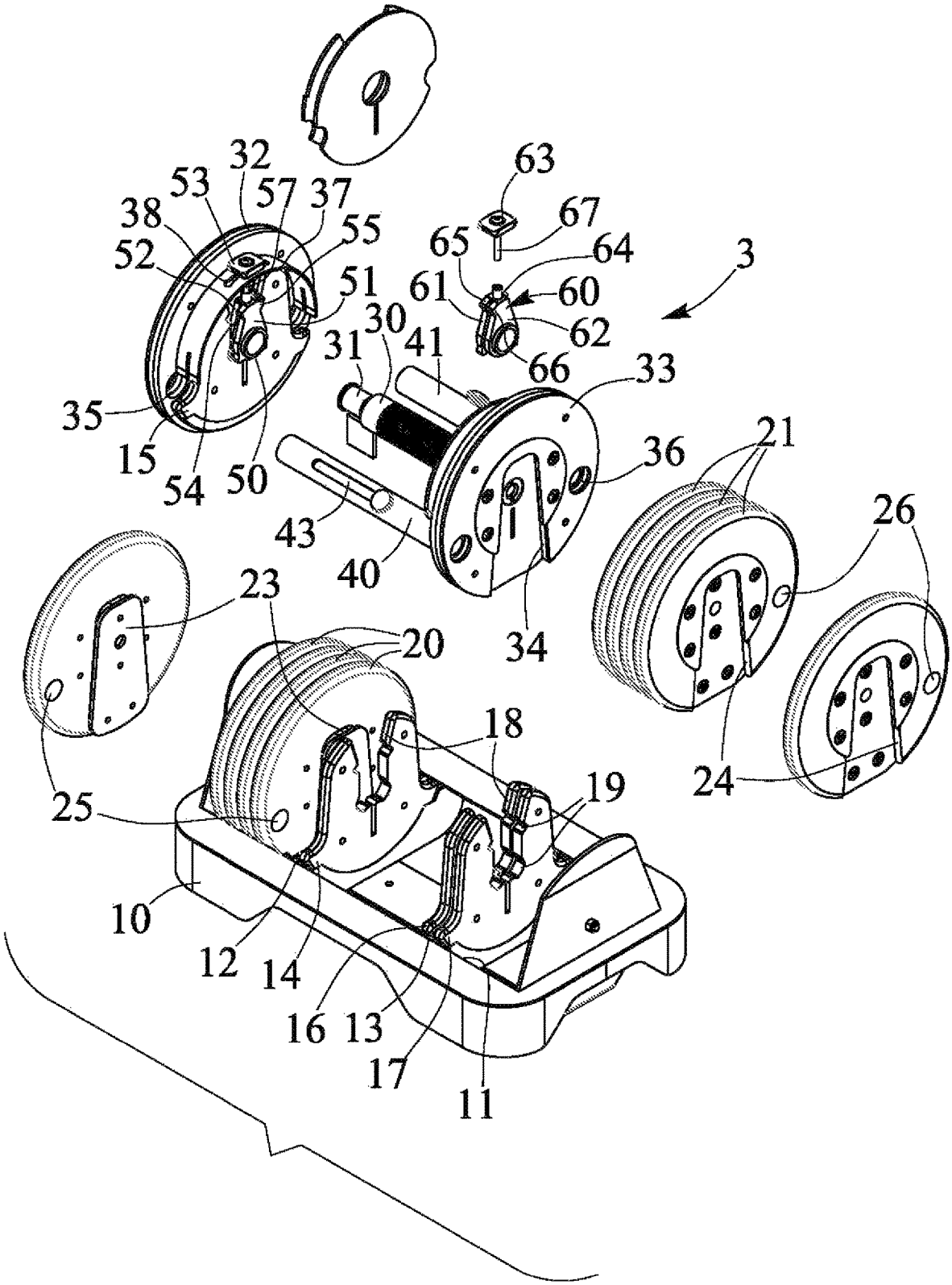
FIG. 2 is another partial exploded view of the adjustable exercise device.
Figure 3:
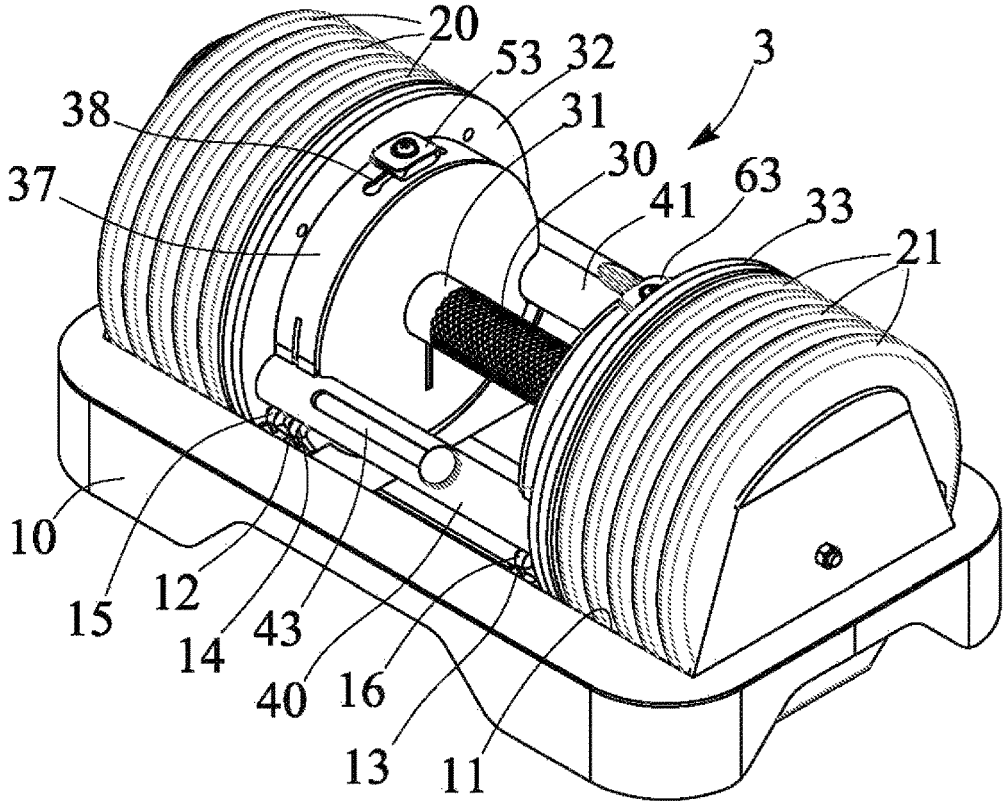
FIG. 3 is a perspective view of the adjustable exercise device.
Figure 4:
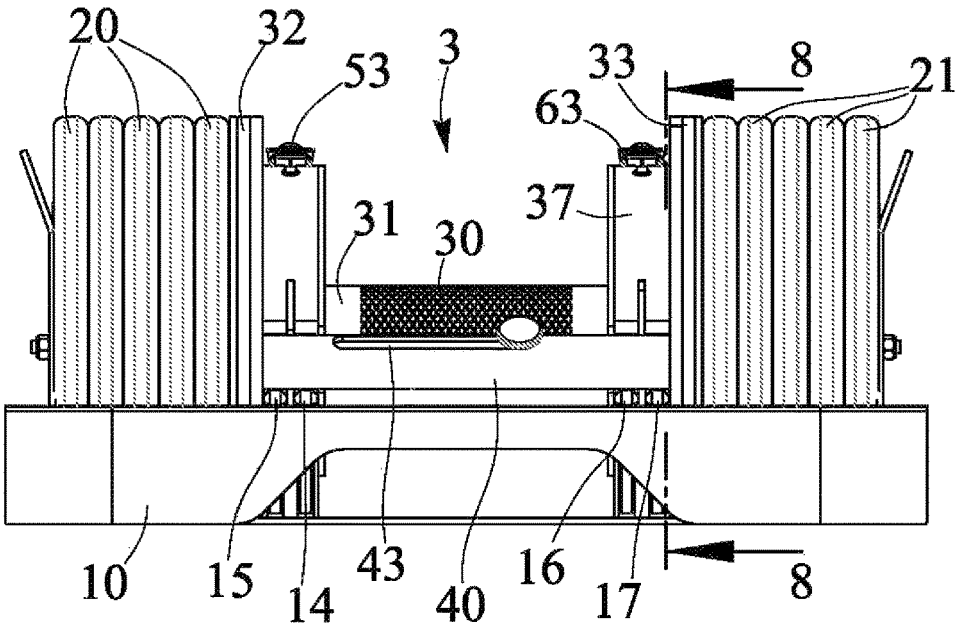
FIG. 4 is a plan schematic view of the adjustable exercise device.

As also best shown in FIGS. 1 and 2, the weight members 20, 21 each include a projection or anchoring element or dovetail 23 formed or provided on the inner side portion thereof, i.e. faced or directed toward the seats 12, 13, and an anchoring member 24, such as dovetail slot 24 formed therein, such as formed in the outer side portion thereof, i.e. faced or directed away from each other and away from the seats 12, 13, for receiving or engaging with the anchoring element or dovetail 23 of the other weight members 20, 21 and for anchoring or retaining or positioning the weight members 20, 21 together, and arranged for allowing the weight members 20, 21 to be moved up and down relative to each other, but arranged for preventing the weight members 20, 21 from being moved sidewise relative to each other and for preventing the weight members 20, 21 from being disengaged or separated from each other. One or the first group of the weight members 20 each include an orifice 25 formed therein and aligned with each other, and the other or the second group of the weight members 21 each include an aperture 26 formed therein and aligned with each other, The adjustable exercise device further comprises a handle mechanism 3 to be disposed and engaged between the two groups of the weight members 20, 21, the handle mechanism 3 includes a central handle bar 30 having one or more (such as two) end portions 31, and having one or more (such as two) housings 32, 33 disposed or extended radially and outwardly from the end portions 31 thereof respectively. The housings 32, 33 each include an anchoring member 34, such as a dovetail slot 34 formed therein, such as formed in the outer side portion thereof, i.e. faced or directed toward the weight members 20, 21 for receiving or engaging with the dovetail 23 of the weight members 20, 21 and for anchoring or retaining or positioning the weight members 20, 21 to the housings 32, 33, and arranged for allowing the weight members 20, 21 to be detachably or changeably or removably and/or adjustably attached or mounted or secured to the housings 32, 33 and/or the end portions 31 of the handle bar 30 of the handle mechanism 3.

Figure 8:
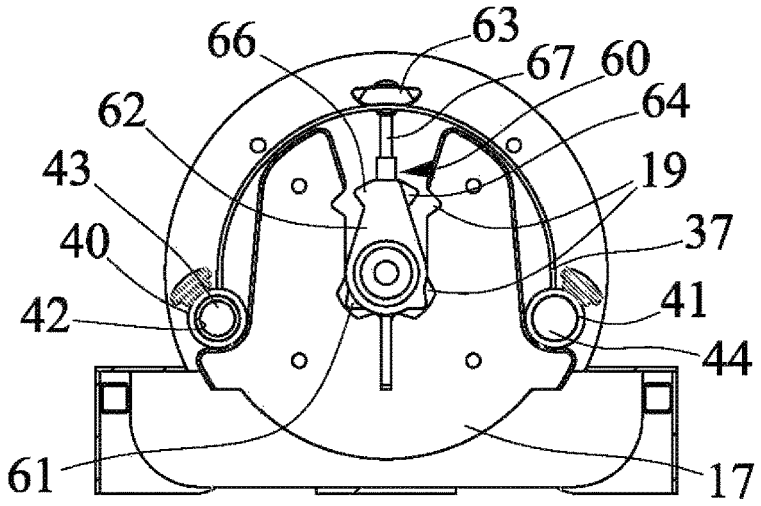
FIG. 8 is a cross sectional view of the adjustable exercise device, taken along lines 8-8 of FIG. 4.
Figure 9:
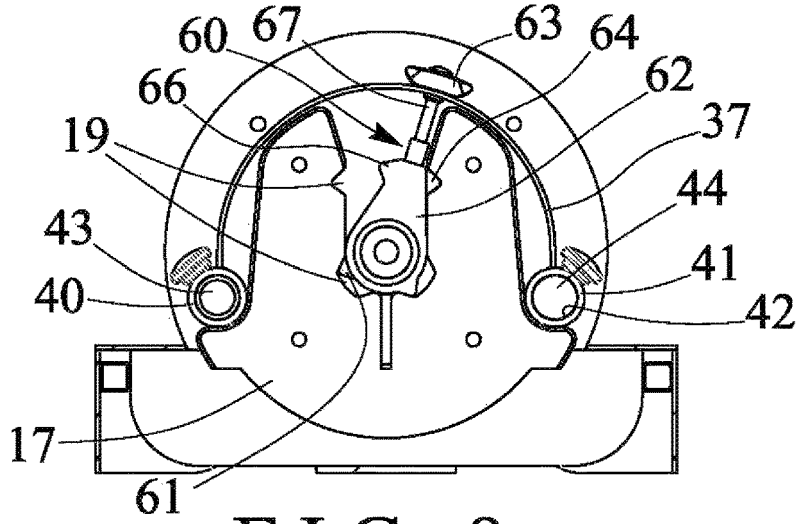
FIGS. 9, 10 are other cross sectional view similar to FIG. 8, illustrating the operation of the adjustable dumbbell assembly.
Figure 10:
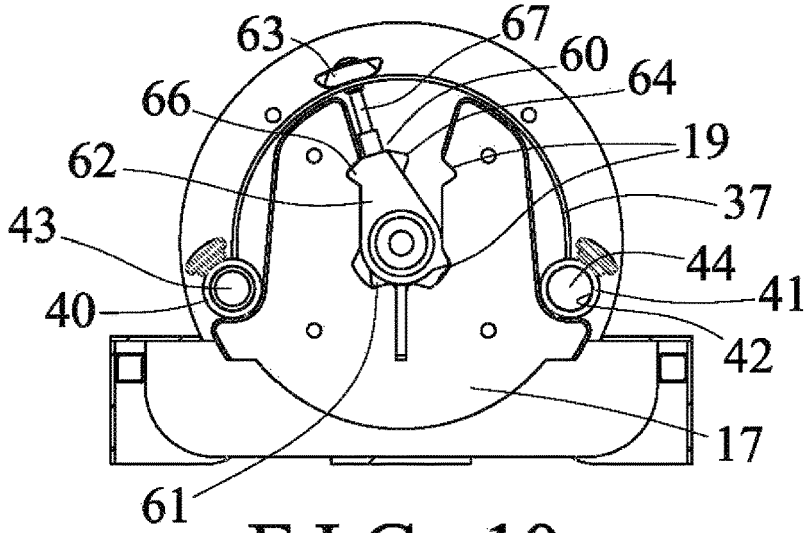

The handle mechanism 3 further includes one or more (such as two) barrels or tubular members 40, 41 disposed and engaged between the housings 32, 33 and offset or spaced or separated from each other, or the tubular members 40, 41 are arranged or disposed opposite to each other. The tubular members 40, 41 each include a chamber or bore 42 formed therein (FIGS. 8-10). One or the first housing 32 includes a passage 35 formed therein (FIG. 2) and aligned with the bore 42 of the first tubular member 40, and the other or the second housing 33 includes a cavity or hole 36 formed therein and aligned with the bore 42 of the second tubular member 41, and two sliding members or latches 43, 44, such as the first latch 43 and the second latch 44 are slidably received or engaged in the bores 42 of the tubular members 40, 41 respectively, and extendible out of the passage 35 and the hole 36 of the housings 32, 33 respectively for selectively engaging with or into the orifices 25 of the first group of the weight members 20 and the apertures 26 of the second group of the weight members 21 respectively, and for selectively and detachably or changeably anchoring or retaining or positioning or coupling a required or predetermined number of the weight members 20, 21 to the housings 32, 33 and the handle bar 30 of the handle mechanism 3 respectively.

The handle mechanism 3 further includes one or more (such as two) cam or actuating members or actuators 50, 60 pivotally or rotatably attached or mounted or secured onto the end portions 31 of the handle bar 30 respectively, and engageable into the opening 18 of the weight elements 14-17 selectively (FIGS. 6, 7), and the actuators 50, 60 include a structure or configuration identical to each other, but disposed or arranged opposite to each other, and each include a two or a first and a second portions or plates or segments 51, 52; 61, 62 for selectively engaging with the weight elements 14-17 respectively and for anchoring or retaining or positioning the weight elements 14-17 to the housings 32, 33, and arranged for allowing the weight elements 14-17 to be detachably or changeably or removably and/or adjustably attached or mounted or secured to the housings 32, 33 and/or the end portions 31 of the handle bar 30 of the handle mechanism 3. Two handgrips or knobs 53, 63 are attached or mounted or secured to the actuators 50, 60 for pivoting or rotating the actuators 50, 60 relative to the housings 32, 33 and/or the handle bar 30 respectively.

The first segments 51, 61 of the actuators 50, 60 each include one or more (such as two) teeth or tongues 54, 55; 64, 65, and the second segments 52, 62 of the actuators 50, 60 each include one or more teeth or projections 56, 66 for engaging with the weight elements 14-17 and for detachably anchoring or retaining or positioning the required or predetermined weight elements 14-17 to the housings 32, 33 and/or to the handle bar 30 selectively. It is to be noted that the tongues 54, 55; 64, 65, and the projections 56, 66 will not be engaged with the weight elements 14-17 when the actuators 50, 60 are erectly or centrally engaged into the opening 18 of the weight elements 14-17 respectively, best shown in FIGS. 5 and 8. As shown in FIGS. 6 and 9, when the actuators 50, 60 are pivoted or rotated relative to the housings 32, 33 in one direction, such as clockwise, one or more, such as the first tongue 54, 64 of the first segment 51, 61 will be forced to engage with the first or the outer weight element 14, 16 that is arranged or located distal to the weight members 20, 21, at this moment, the projections 56, 66 of the second segments 52, 62 are not engaged with the second or the inner weight element 15, 17 that is arranged or located close to the weight members 20, 21.

As shown in FIGS. 7 and 10, when the actuators 50, 60 are pivoted or rotated relative to the housings 32, 33 in the other direction, such as counter-clockwise, one or more, such as the second tongue 55, 65 of the first segment 51, 61 will be forced to engage with the first or the outer weight element 14, 16, at this moment, the projections 56, 66 of the second segments 52, 62 will be forced to engage with the second or the inner weight element 15, 17 that is arranged or located close to the weight members 20, 21 and arranged for allowing both the first or the outer and the second or the inner weight elements 14, 16; 15, 17 to be anchored or retained to the handle mechanism 3 and to be lifted and disengaged from the receptacle 10 and the weight members 20, 21 (FIG. 7). The housings 32, 33 each may further include a curved guide flap or frame 37 formed or provided thereon, and the guide frames 37 each include a slot or groove 38 formed therein, and the knobs 53, 63 leach include a pin 57, 67 extended therefrom and slidably received or engaged in the groove 38 of the guide frame 37 for guiding and limiting the actuators 50, 60 to pivot or rotate relative to the housings 32, 33.

In operation, as shown in FIGS. 5 and 8, when the actuators 50, 60 are erectly or centrally engaged into the opening 18 of the weight elements 14-17, and when the actuators 50, 60 are not pivoted or rotated relative to the housings 32, 33, the tongues 54, 55; 64, 65, and the projections 56, 66 will not be engaged with the weight elements 14-17 and will not anchor or retain or position the weight elements 14-17 to the housings 32, 33, the latches 43, 44 may be selectively engaged with the required or predetermined number of the weight members 20, 21 and to anchor or retain or position the required or predetermined number of the weight members 20, 21 to the housings 32, 33 and the handle bar 30 of the handle mechanism 3. As shown in FIGS. 6 and 9, when the actuators 50, 60 are pivoted or rotated relative to the housings 32, 33 in one direction, such as clockwise, the first tongue 54, 64 of the first segment 51, 61 will be engaged with the first or the outer weight element 14, 16 for anchoring or retaining or positioning the first or the outer weight element 14, 16 to the housings 32, 33.

As shown in FIGS. 7 and 10, when the actuators 50, 60 are pivoted or rotated relative to the housings 32, 33 in the other direction, such as counter-clockwise, the second tongue 55, 65 of the first segment 51, 61 will be engaged with the first or the outer weight element 14, 16 to anchor or retain or position the first or the outer weight element 14, 16 to the housings 32, 33. At this moment, the projections 56, 66 of the second segments 52, 62 will be engaged with the second or the inner weight element 15, 17 for allowing both the first or the outer and the second or the inner weight elements 14, 16; 15, 17 to be anchored or retained to the handle mechanism 3 and to be lifted and disengaged from the receptacle 10 and the weight members 20, 21 (FIG. 7). It is to be noted that the weight elements 14-17 include a weight or size or standard smaller than that of the weight members 20, 21 for allowing the weight of the adjustable exercise device or the adjustable dumbbell device to be micro-adjusted.

Accordingly, the adjustable exercise device in accordance with the present invention includes an adjustable structure or configuration for micro adjusting the weight of the adjustable exercise device, and arranged for allowing the weight or the size or the standard of the weight members or of the adjustable exercise device or the adjustable dumbbell device to be suitably micro-adjusted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a receptacle, a first weight member and a second weight member engageable to said receptacle, two first weight elements engaged on said receptacle and engaged between said first and said second weight members, two second weight elements engaged on said receptacle and engaged between said first and said second weight members, said first weight elements being located closer to said first and said second weight members than said second weight elements, and a handle mechanism engaged between said first and said second weight members for anchoring said first and said second weight members to said handle mechanism, said handle mechanism including:

a handle bar having two end portions, first and second housings disposed on said end portions of said handle bar respectively, two actuators pivotally attached to said end portions of said handle bar for engaging with said first and said second weight elements respectively, and said actuators each including a first segment for engaging with said first weight element, and a second segment for engaging with said second weight element respectively and for detachably anchoring said first and said second weight elements to said housings and said handle bar.

2. The adjustable exercise device as claimed in claim 1, wherein said actuators each include a first tongue formed on said first segment for engaging with said first weight element when said actuators are rotated relative to said first and said second housings in one direction, a second tongue formed on said first segment for engaging with said first weight element when said actuators are rotated relative to said first and said second housings in an opposite direction, and a projection formed on said second segment for engaging with said second weight element when said actuators are rotated relative to said first and said second housings in the opposite direction.

3. The adjustable exercise device as claimed in claim 1, wherein said first and said second weight elements each include at least one depression for engaging with said first and said second tongues and said projection.

4. The adjustable exercise device as claimed in claim 3, wherein said first and said second weight elements each include an opening for receiving and engaging with said actuators respectively, and said at least one depression of said first and said second weight elements is communicating with said opening of said first and said second weight elements.

5. The adjustable exercise device as claimed in claim 1, wherein said actuators each include a knob for rotating said actuators relative to said first and second housings and said handle bar respectively.

6. The adjustable exercise device as claimed in claim 5, wherein said first and second housings each include a groove formed in said first and second housings respectively, and said actuators each include a pin extended from said knob and slidably received and engaged in said groove of said first and second housings for guiding and limiting said actuators to or rotate relative to said first and second housings.

7. The adjustable exercise device as claimed in claim 6, wherein said first and second housings each include a frame, and said groove is formed in said frame.

8. The adjustable exercise device as claimed in claim 1, wherein said handle mechanism includes first and second tubular members engaged between said first and second housings and separated from each other, a bore is formed in each of said first and second tubular members respectively, said first weight member includes an orifice formed in said first weight member, and said second weight member includes an aperture formed in said second weight member, a first latch is slidably received and engaged in said bore of said first tubular member for engaging with said orifice of said first weight member and for retaining said first weight member to said first housing, and a second latch is slidably received and engaged in said bore of said second tubular member and extendible out of said aperture of said second housing for engaging with said aperture of said second weight member and for retaining said second weight member to said second housing.

9. The adjustable exercise device as claimed in claim 8, wherein said first housing includes an opening formed in said first housing and aligned with said bore of said first tubular member, and said second housing includes a hole formed in said second housing and aligned with said bore of said second tubular member.

* * * * *